US006227385B1

(12) United States Patent
Nickerson

(10) Patent No.: US 6,227,385 B1
(45) Date of Patent: May 8, 2001

(54) SHELF TRAY SYSTEM

(75) Inventor: Terry L. Nickerson, Brookfield, WI (US)

(73) Assignee: DCI Marketing, Inc., Milwaukee, WI (US)

( * ) Notice: Subject to any disclaimer, the term of this patent is extended or adjusted under 35 U.S.C. 154(b) by 0 days.

(21) Appl. No.: 09/454,784

(22) Filed: Dec. 3, 1999

(51) Int. Cl.[7] ..... A47F 1/04

(52) U.S. Cl. ..... 211/59.3; 211/175; 211/184; 108/61

(58) Field of Search ..... 211/59.3, 59.2, 211/175, 184; 108/61

(56) References Cited

U.S. PATENT DOCUMENTS

| | | | |
|---|---|---|---|
| D. 277,154 | 1/1985 | Nasgowitz . | |
| 2,098,844 | 11/1937 | Waxgiser . | |
| 2,110,299 | 3/1938 | Hinkle . | |
| 2,129,122 | 9/1938 | Follett . | |
| 2,668,648 | 2/1954 | Carlsen . | |
| 2,769,551 | 11/1956 | Just . | |
| 3,008,583 | 11/1961 | Lindell . | |
| 3,083,067 | 3/1963 | Vos et al. . | |
| 3,161,295 | 12/1964 | Chesley . | |
| 3,348,732 | 10/1967 | Schwarz . | |
| 3,452,899 | 7/1969 | Libberton . | |
| 4,130,203 | 12/1978 | Russell, III . | |
| 4,300,693 | 11/1981 | Spamer . | |
| 4,314,648 | 2/1982 | Spamer . | |
| 4,685,574 | 8/1987 | Young et al. . | |
| 4,724,968 | 2/1988 | Wombacher . | |
| 4,730,741 | 3/1988 | Jackie, III et al. . | |
| 4,785,945 | 11/1988 | Rowse et al. . | |
| 4,830,201 | 5/1989 | Breslow . | |
| 4,960,210 | 10/1990 | Spamer . | |
| 5,012,936 | 5/1991 | Crum . | |
| 5,022,535 | 6/1991 | Spamer . | |
| 5,366,099 | 11/1994 | Schmid . | |
| 5,390,802 * | 2/1995 | Pappagallo et al. | 211/59.3 |
| 5,450,968 | 9/1995 | Bustos . | |
| 5,542,552 | 8/1996 | Yablans et al. . | |
| 5,605,237 | 2/1997 | Richardson et al. . | |
| 5,614,288 | 3/1997 | Bustos . | |
| 5,665,304 | 9/1997 | Heinen et al. . | |
| 5,673,801 | 10/1997 | Markson . | |
| 5,746,328 | 5/1998 | Beeler et al. . | |
| 5,769,248 | 6/1998 | Johnson . | |
| 5,855,283 | 1/1999 | Johnson . | |

* cited by examiner

*Primary Examiner*—Daniel P. Stodola
*Assistant Examiner*—Erica B. Harris
(74) *Attorney, Agent, or Firm*—Michael Best & Friedrich LLP

(57) ABSTRACT

A self-facing, add-on shelf system is made up of universal base, divider, front, and rear sections. Universal in the sense that these sections form basic building sections for constructing shelf systems of various sizes and operational mode. The front and rear track sections are identical and can be combined with various combinations of bases, dividers and end sections to provide systems of different, desired widths. The depth of the self-facing shelf is generally set by the depth of the shelf with which it is to be used. The individual sections can be selected and combined to provide center pusher, side pusher, and gravity feed types of self facing systems. The bases, dividers and end sections are configured such that they can be extruded and interlock in assembly.

17 Claims, 5 Drawing Sheets

SHELF TRAY SYSTEM

FIELD OF THE INVENTION

This invention relates to point of purchase marketing and, more particularly, to systems and/or apparatus for displaying product at the point of purchase.

BACKGROUND OF THE INVENTION

A commonly accepted practice in one area of the point of purchase industry, grocery stores and the like, is to display product on shelves for selection by the consumer. In those types of applications it is known to arrange product in add-on, self-facing tray units which are attached to the principal store shelf. Product is displayed in the add-on, self-facing tray units in a manner allowing it to be viewed by the consumer and such that, if a selection is made, the selected item can be readily removed by the consumer. In the past it has also been proposed to construct this type of unit so that product displayed on the shelf is automatically fed to the forward end of the shelf as product is removed. This forward feeding has been accomplished by gravity feed where the add-on unit is pitched forward toward its front end. Another arrangement for forward feeding uses a spring arrangement which continually urges disk displayed product forward so that when a product is removed the remaining products in the add-on tray are urged forward. A combination of gravity feed and spring movement has also been proposed.

These types of trays organize product for display and purchase.

Among the considerations in providing an acceptable add-on, self-facing tray construction is the fact that the products to be displayed and dispensed will vary in size. Another problem is that the store shelf space that may be allotted to a product will vary depending on the needs of the store.

SUMMARY OF THE INVENTION

Among the objects of this invention is to provide an add-on, self-facing shelf tray which has universal application with respect to size of product which it displays and in adapting to the amount of store shelf space that can be allocated to the product. A further objective is to provide that product display versatility in a construction which is cost effective to produce, easily put into use on a store shelf, and durable.

For the achievement of these and other objects this invention proposes, a self fading shelf tray is made up of basic, interchangeable parts. The parts are extruded and designed so that they can be easily sized to adapt to any number of applications, i.e., shelf space. The parts are also designed so as to reduce the number and complexity of tooling and dies. The parts are further configured so that in assembly they interlock with each other and through the interlock maintain their assembled relationship.

The parts are readily adapted for use in conjunction with a center oriented, product pusher. The product pusher is spring biased and urges product toward the front of the tray as product is removed from the tray by the consumer. Additionally, the parts are readily adapted for use in conjunction with a side pusher arrangement. The side pusher is also spring biased and accomplishes the same function as the center pusher, the difference being the pusher plate is supported from a side member of the tray as opposed to a central base member.

Other features and advantages of the invention will become apparent to those skilled in the art upon review of the following detailed description, claims and drawings.

DESCRIPTION OF THE PREFERRED EMBODIMENT

Figure 1:
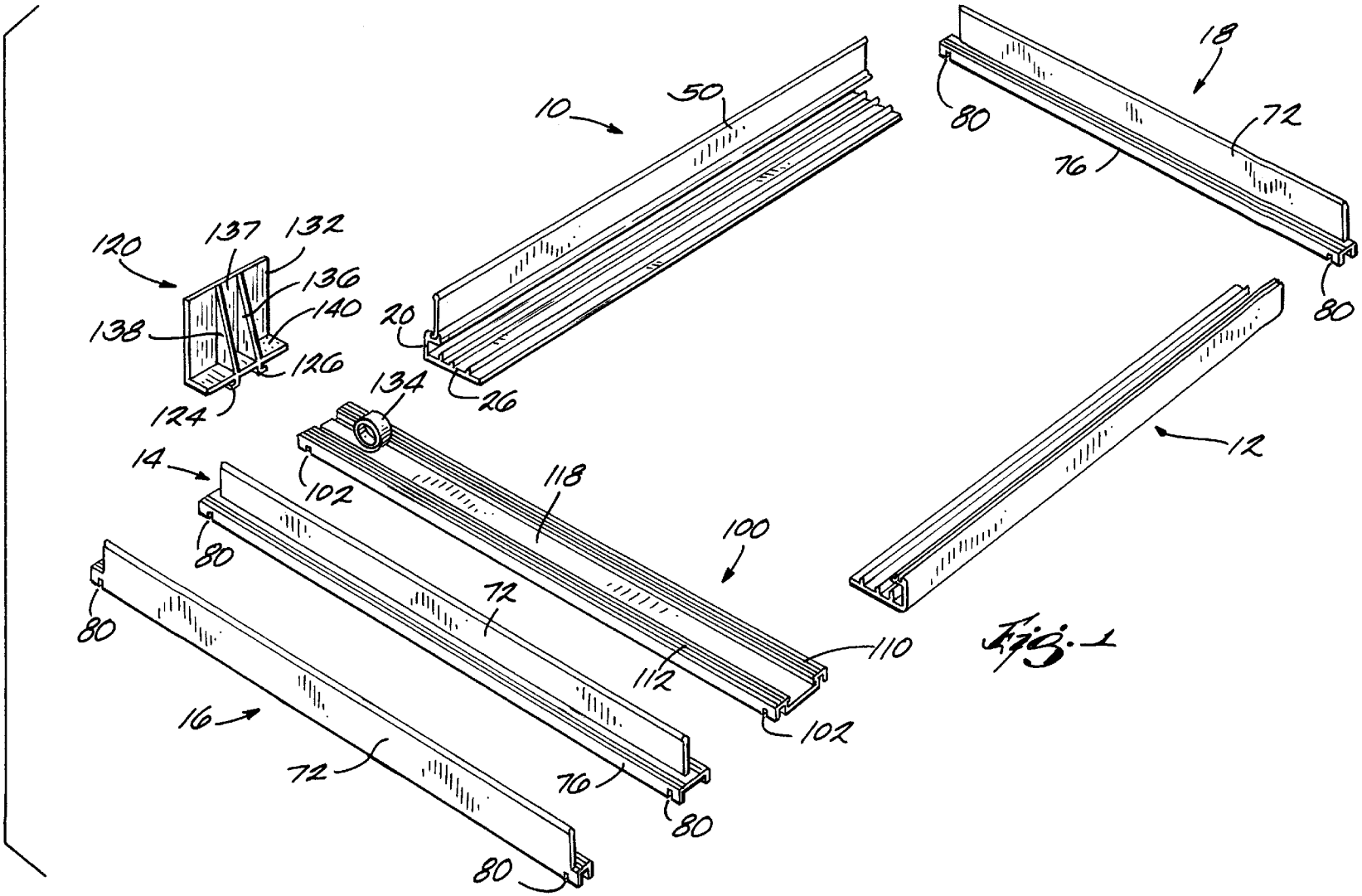
FIG. 1 is an exploded perspective illustrating both a gravity feed embodiment and a center oriented pusher embodiment.

The add-on, self-facing shelf trays of this invention can come in a variety of configurations including (1) a gravity feed arrangement, (2) a base mount version where a pusher track with a suitable biasing means is provided as the base of the unit and (3) a side mount version where a suitable biasing means is supported from a side wall of the unit. In each version the biasing means urges the stored product toward the front of the tray.

In a preferred embodiment, the tray includes a front track 10, a rear track 12, an interior or center divider 14, and end dividers 16 and 18.

Figure 2:
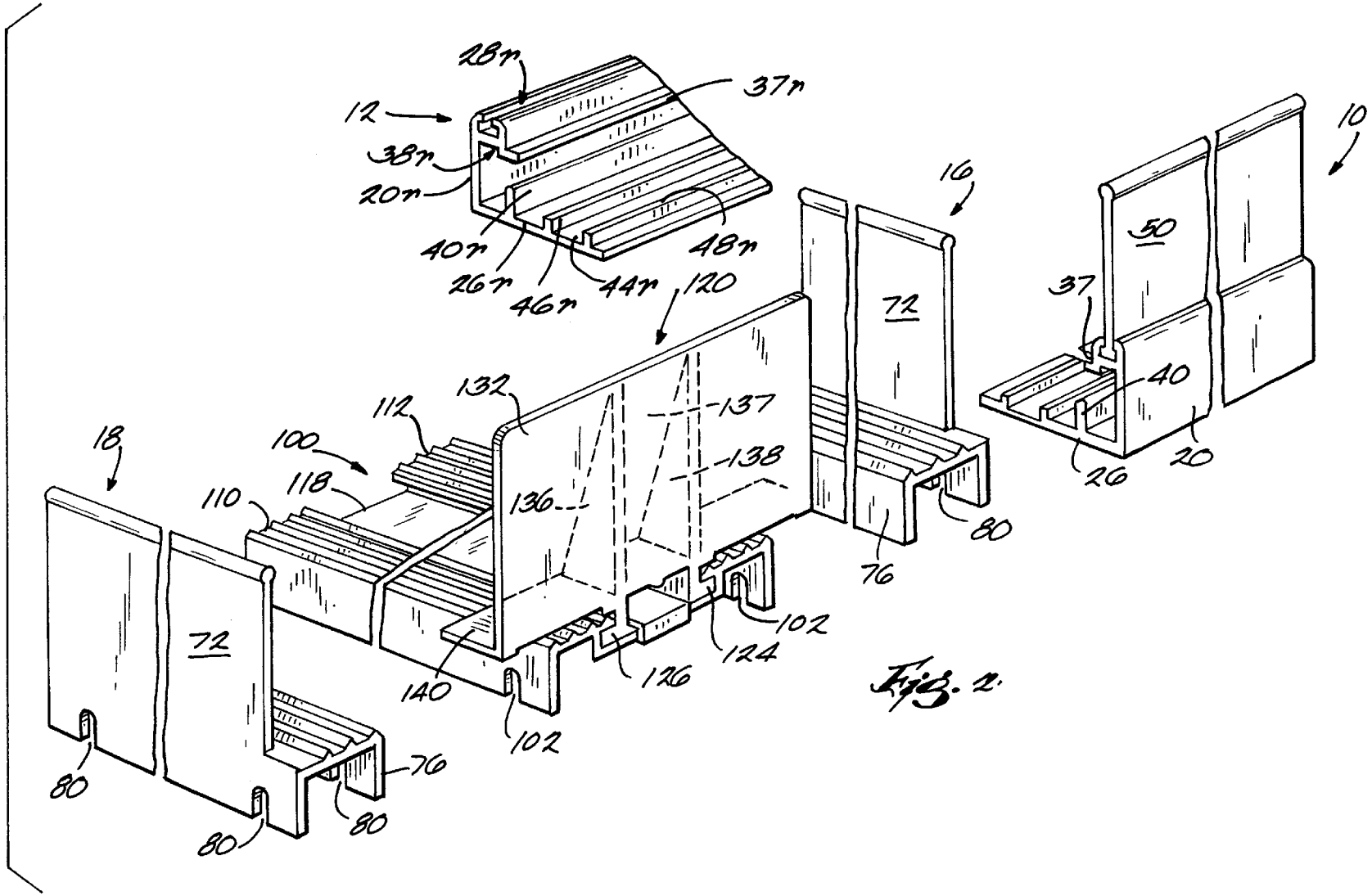
FIG. 2 is an enlarged view of a portion of FIG. 1.
Figure 4:
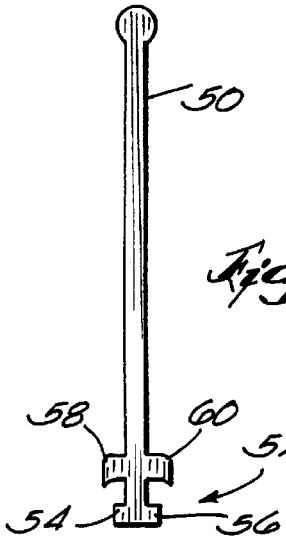
FIG. 4 is an end view of the front track insert.
Figure 3:
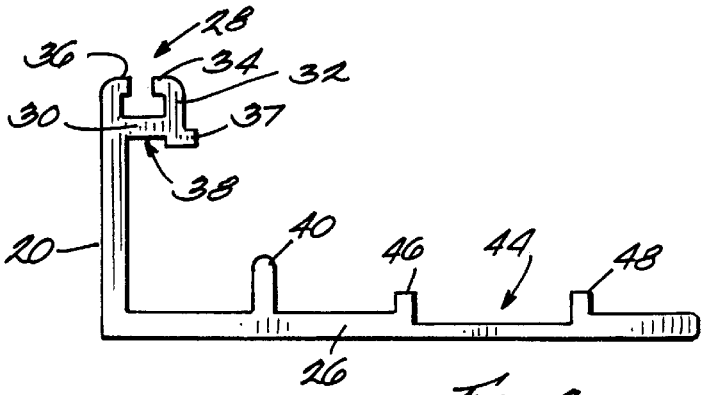
FIG. 3 is an end view of the front and rear track.

Looking at the front track 10 in FIGS. 1–3, it has a planar, generally vertical or front panel 20 which will extend vertically when in use. The front panel 20 has outer and inner surfaces. A generally horizontal or support panel 26 extends from the lower end of the inner surface of the front panel 20 and will project rearwardly when in use. The front and support panels 20, 26 are elongated and linear along their respective extensions.

With reference to FIG. 3, the upper end of the front panel 20 includes a slot 28. That is, a horizontal web 30 extends from the inner surface of the front panel 20. In the illustrated embodiment, the web 30 is generally parallel to the support panel 26 and is at a right angle to inner surface of the front panel 20, but of limited rearward extension as compared to the support panel 26. A vertical leg 32 extends upwardly from the web 30 and terminates in a forwardly turned nose 34 above the web 30. Similarly, the upper end of the front panel 20 terminates in a rearwardly turned nose 36 that is opposed to but spaced from the nose 34. That structure defines slot 28 which extends the length of the front track 10 but has a restricted entrance to its interior. The purpose for this slot 28 will be explained hereinafter.

Still referring to FIG. 3, the upper end of the front panel 20 includes a lip 37 that extends rearwardly of and partially below the web 30 and extends along the length of the front track 10. This lip 37 is spaced from the inner surface of the front panel 20, and together with the web 30 and the inner surface of the front panel 20, defines a downwardly facing recess 38. The use of this recess 38 also will be explained hereinafter.

Still referring to FIG. 3, a holding rib 40 is provided on the support panel 26. The holding rib 40 is spaced rearwardly of the recess 38 and extends upwardly from the support panel 26.

Completing the structure of the front track 10 is an elongated slot 44 recessed downwardly from the upper surface of the support panel 26 and extending the length of the front track 10 and parallel to front panel 20. Two upward projecting ribs 46 and 48 are provided, one on either side of the slot 44. These are of a different material than the front track 10 itself. The front track 10 is extruded and made of a conventional polyvinyl chloride except for the ribs 46 and 48 which are made of a softer polyvinylchloride and are co-extruded with the remainder of the front track 10.

The rear track 12 is identical to the front track 10. Therefore, the rear track 12 is not separately illustrated except as it is part of the overall assembly. Where reference is necessary to the rear track 12, portions corresponding to the already-described front track 10 are identified by the same number but with the addition of the letter "r" (see for example, FIG. 2).

Referring again to FIG. 3, an insert 50 is carried on the front track. The insert 50 helps retain the product behind the front track 10 but is made of a clear acrylic so that it does not interfere with viewing the product. The insert 50 is basically a planar, elongated strip but with a specially configured bottom end 52 which is complementary to the upper end of the front panel 20. More particularly, the bottom end 52 is generally "I" shaped in cross-section having horizontal tabs 54 and 56 projecting laterally from both sides of the insert 50 and dimensioned to fit into the slot 28 in the upper end of the front panel 20. To stabilize the insert 50 on the front track 10 two additional horizontal tabs 58 and 60 are spaced vertically above tabs 54 and 56. The tabs 58 and 60 will rest on the top of the opposed noses 36 and 34. It will be noted that tabs 58 and 60 are generally arcuate and concave in cross section to nest on top of the front panel noses 36 and 34.

All of the surfaces, ribs, slots and recesses are straight, linear projections extending the full length of the front track 10 and insert 50.

The end and the interior dividers 14, 16, 18, which are used in some applications will now be described. In some aspects the end and the interior dividers have the same construction as each other. Before specifically describing the end dividers 16, 18, it will be noted that in accordance with the preferred embodiment of this invention the same end divider 16 or 18 can be used to close both ends of the add-on, self-facing unit.

Figure 5:
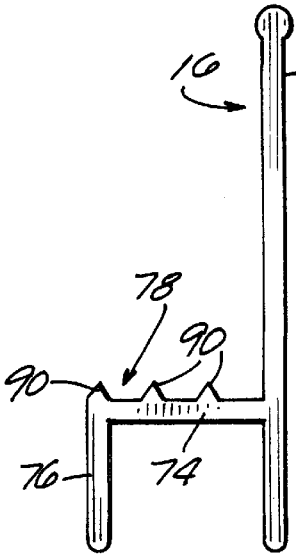
FIG. 5 is an end view of the end divider.

The end dividers 16, 18 are substantially identical to each other and are arranged opposite each other as mirror images. Further discussion will relate only to end divider 15 unless specifically stated otherwise, it being understood that the discussion relates equally to end divider 18. The same reference numerals are used to identify aspects of end divider 18 as end divider 16, and where an aspect is only seen on one of the end dividers 16, 18 in the drawings, it will be understood that the feature is also present on the other end divider 18, 16. The end divider 16 illustrated in FIGS. 1, 2, and 5 includes a vertical panel 72, a horizontal section 74, and a second vertical, shorter panel 76 spaced from and generally parallel to the longer, vertical panel 72. The top surface of the horizontal section 74 forms a support ledge 78 extending the length of the end divider 16. With specific reference to FIGS. 1 and 2, slots 80 are provided at both ends of the divider 16 in the lower edge of the vertical panel 72 and shorter vertical panel 76. These slots 80 are aligned and sized to fit over the rib 40 on the front track 10 and the rib **40*r* on the rear track 12. Through the interengagement of the ribs 40 and 40*r* and the slots 80, the end dividers 16, 18 are held in place between the front and rear tracks 10, 12**.

To prevent the end dividers 16, 18 from moving vertically relative to front and rear tracks 10, 12 the front and rear ends of the horizontal section 74 are positioned beneath the recess 38 on the front track 10 and recess **38*r* on the rear track 12 and thereby held in place by the webs 30 and 30*r* and the lips 37, 37*r* (FIG. 2). It will be noted that to close the right and to left ends of the add-on, self-facing tray the same end pieces 16, 18** are used with one being reversed or turned end for end with respect to the other.

Figure 10:
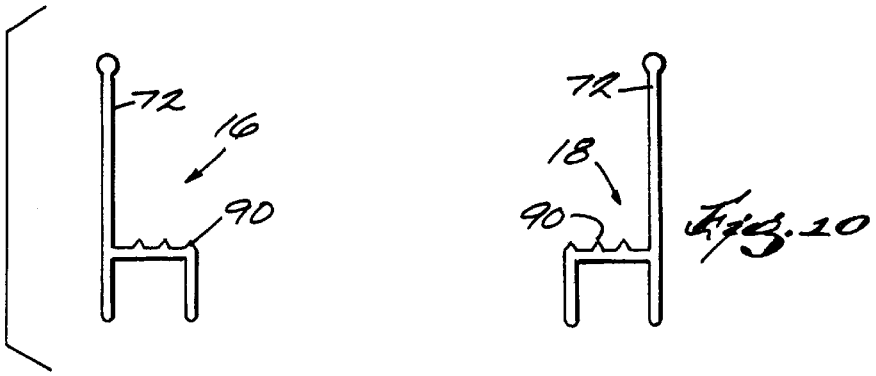
FIG. 10 is an end view of a single gravity feed embodiment.

When the tray is assembled, product is supported on the ledges 78 and between the front and rear tracks 10, 12. In the embodiment illustrated in FIGS. 1–5 the rear track 12 will be suitably elevated with respect to the front track 10 so that product displayed in the unit will be fed by gravity toward the front of the unit as one or more products are removed. To facilitate this gravity feed a plurality of pointed, relatively spaced ribs 90 (FIG. 5) are provided on the upper surface of ledges 78. FIG. 10 provides an example of how the end dividers 16, 18 would be positioned to provide a gravity feed of product, where the product would span the space between the end dividers 16, 18 and slide on the projections 90.

Figure 7:
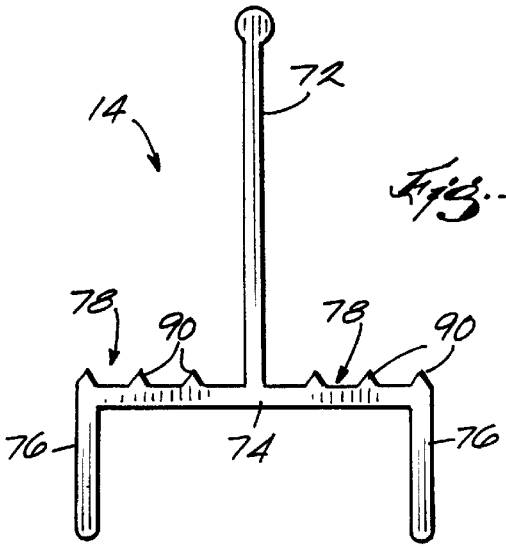
FIG. 7 is an end view of the center divider track.
Figure 8:
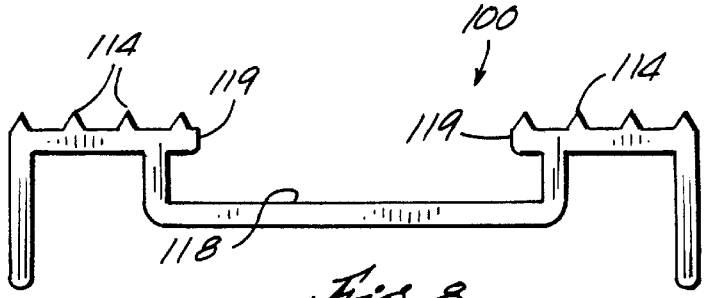
FIG. 8 is an end view of the center pusher track.
Figure 11:
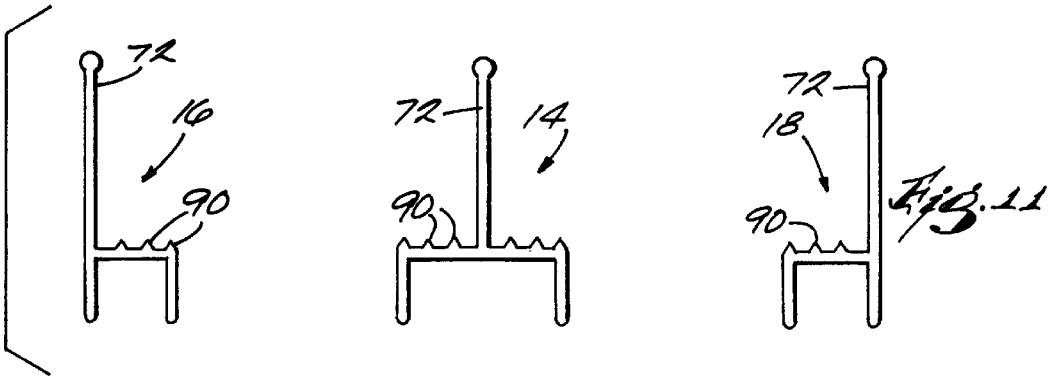
FIG. 11 is an end view of two, side-by-side gravity feed embodiment.

The interior divider 14 is illustrated in FIGS. 1 and 7, and includes similar aspects as the end dividers 16, 18 with some modifications. For example, the vertical panel 72 is centrally-located on the interior divider 14, and the interior divider 14 includes a shorted vertical panel 76 on each side. The horizontal section 74 of the interior divider 14 also includes support ledges 78 and ribs 90 on both sides of the vertical panel 72. The interior divider includes slots 80 similar to those of the end dividers 16, 18. FIG. 11 illustrates a gravity feed arrangement including end dividers 16, 18 on either side of the interior divider 14. Product would span the space between the end dividers 16, 18 and the interior divider 14 on either side of the interior divider's vertical panel 72, such that two columns of produce would be slidable on the projections 90 of the dividers 14, 16, 18.

Again it will be noted that all surfaces, panels, ledges and ribs are straight linear projections extending the full length of the interior and end dividers 14, 16, 18, except the vertical panels 72, which are truncated to permit the ends of the dividers 14, 16, 18 to be inserted under the recesses **38, 38*r*** as described above.

The basic self-facing unit described to this point can be adapted for a spring feed of the displayed product toward the front of the unit in one of two variations: a center pusher and a side pusher.

Figure 12:
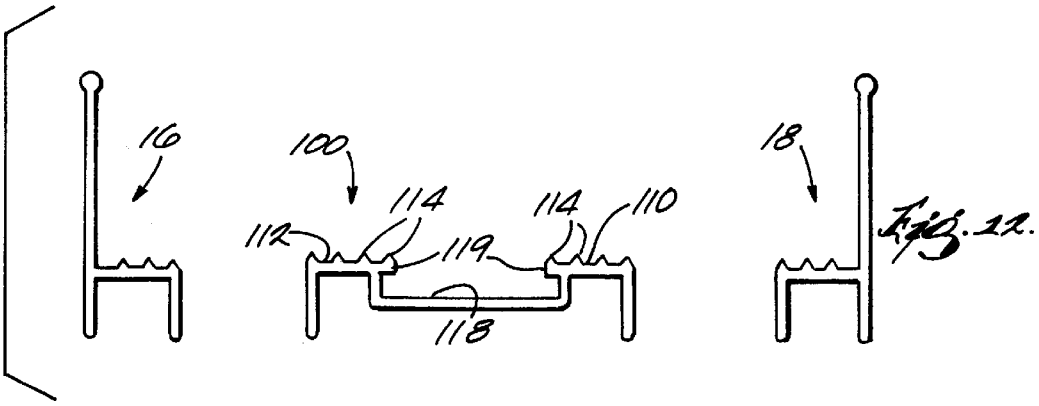
FIG. 12 is an end view of a center, pusher embodiment.

In the center pusher variation, illustrated in FIGS. 1, 2, and 12, a pusher track 100 is positioned between the end dividers 16, 18. A pusher track 100 may also be positioned on either side of the interior divider 14 illustrated in FIG. 11, between the interior divider 14 and the end dividers 16, 18. The pusher track 100 includes aligned slots 102 in the front and rear end that fit onto ribs 40 and 40R. In addition, the pusher track 100 is provided with two relatively spaced horizontal ledges 110 and 112 which extend beneath the recesses 38, 38*r* to be held in place by the webs 30, 30*r* and lips 37, 37*r* in the same fashion as the dividers 14, 18. Ledges 110 and 112 are provided with a plurality of relatively spaced, pointed ribs 114 (see FIG. 12) for the same purpose as ribs 90 on the dividers 14, 16, 18.

A centrally located, U-shaped in configuration recess 118 extends down the center of the pusher track 100 and between ledges 10 and 112. Ledges 110 and 112 provide overhanging lips 119 on either side of the recess 118. The recess 118 and the lips 119 extend the length of the pusher track 100. The ledges 110, 112, recess 118, ribs 114, and lips 119 of the pusher track 100 are substantially straight and linear and extend the full length of pusher track 100.

Pusher plate 120 is positioned in and extends above the recess 118 (see FIGS. 1 and 2). More specifically, pusher plate 120 includes a base which is made up of two oppositely facing C-shaped in cross section members 124 and 126. These C-shaped members 124, 126 define slots which engage the lips 119 of the pusher track 100. A planar panel 132 is positioned above the C-shaped members 124 and 126 and is integrally molded therewith.

A coil spring 134 (FIG. 1) has one end fastened to the front track 10. The coil spring 134 extends through the space defined by recess 118 and the coiled portion of the spring 134 rests in a channel 137 defined on the back face of planar panel 132. The channel 137 is defined between two angular ribs 136 and 138 molded to the rear face of panel 132 and to a horizontal portion 140, from which the C-shaped members 124, 126 depend.

With this arrangement, the pusher plate 120 can be slid in the recess 118 toward the rear track 12 with product being filled between the pusher plate 120 and the front track 10. When the desired number of products are loaded into the tray, the product holds the pusher plate 120 in spaced relationship from the front track 10 against the biasing force of the coil spring 134. As product is removed from the front of the unit, the pusher plate 120 under the influence of the spring 134 urges the product toward the front track 10. It will also be noted that the horizontal portion 140 extends over and is supported on the ledges 110, 112 of the pusher track 100 and the ledges 78 of the end dividers 16, 18.

Figure 6:
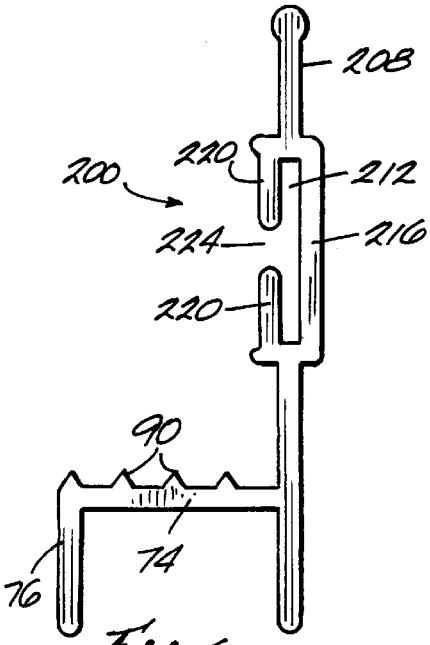
FIG. 6 is an end view of the end pusher plate construction.
Figure 9:
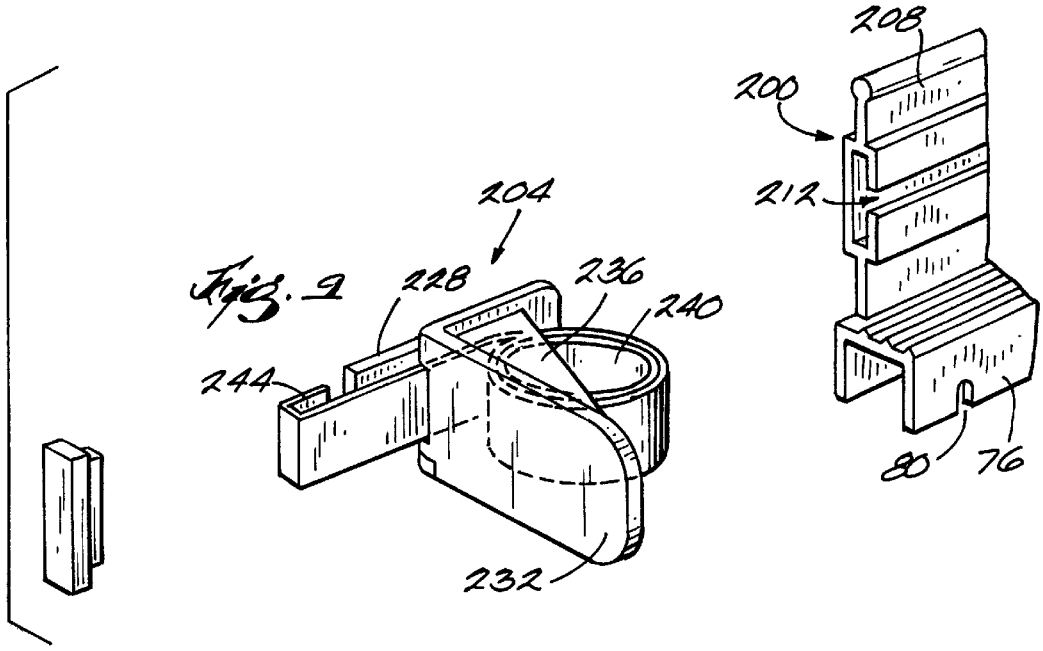
FIG. 9 is an exploded, perspective view of the side pusher embodiment of the invention.
Figure 13:
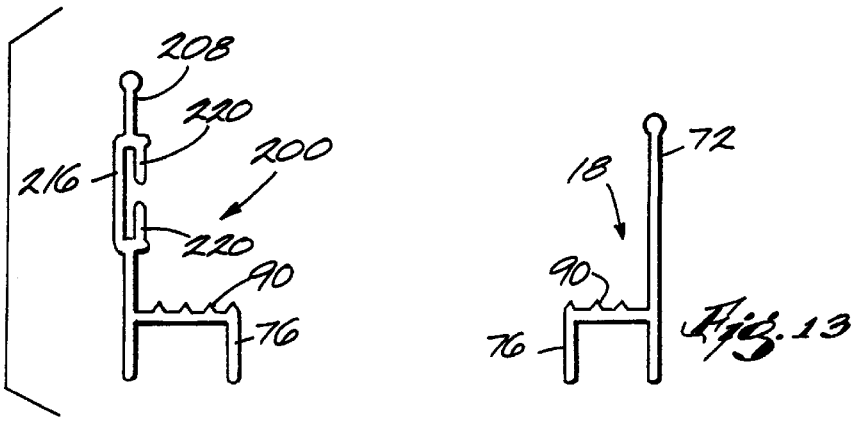
FIG. 13 is an end view of a side, pusher embodiment.

A second version of the mechanically fed unit is illustrated in FIGS. 6, 9, and 13. This side-mounted pusher assembly includes an adapted end divider 200 in combination with an above-described interior or end divider 14, 16, 18. Because the adapted end divider 200 includes many of the same structural aspects as the dividers 14, 16, 18 described above the same reference numerals are used in FIGS. 6, 9, and 13 where appropriate.

The pusher assembly includes a pusher plate 204 which is attached to and movable on the modified end divider 200. More particularly, in this modification, the vertical panel 208 of the modified end divider 200 is provided with a slot 212. This slot 212 includes a back wall 216 which is substantially parallel to and non-coplanar with the rest of the panel 208. The slot 212 also includes two L-shaped projections 220 which project from the opposite side of panel 208. The L-shaped members 220 terminate in spaced relationship defining an opening 224 to the slot 212.

Turning to FIG. 9, the pusher 204 includes a T-shaped in cross section tab 228 which fits into the slot 212 to hold the pusher 204 in but movable relative to slot 212. The side pusher 204 includes a front panel 232, and two ribs 236 (one of which is visible in FIG. 9) which define a channel on the rear of panel 232. A coil spring 240 fits into the channel. The end 244 of the coil spring 240 is U-shaped and fits over the front edge of the back wall 216 to an anchor the coil spring 240. With this arrangement, the pusher 204 can be moved along the length of the panel 208 to allow product to be loaded into the unit and then, in the same manner as the previously described pusher 120, the spring 240 will urge the product forward as product is removed. The surfaces, ribs, slots of the modified end divider 200 are all straight, linear projections extending the full length of the end divider.

To add to the versatility of this unit, it will be noted that an interior divider 14 can be modified to have the vertical panel 208, and may be used with an end divider 16, 18 with or without the slots 212 to accommodate the side pusher. With this arrangement, two or more side-by-side gravity feed units can be provided. Therefore, the basic parts can be assembled with two spaced end dividers to receive product therebetween. With this configuration, the units can be set up to accommodate a single row of product or multiple adjacent rows of the products, and with different configurations. As mentioned above, some arrangements of the dividers 14, 16, 18, 200 are shown in FIGS. 10–13.

What is claimed is:

1. A shelf unit comprising, in combination, a front track section having a planar, generally vertical panel and a generally horizontal panel attached to and extending from said vertical panel, said front vertical and horizontal panels being elongated and linear along their respective extensions, a rear track section having a generally vertical panel and a generally horizontal panel attached to and extending from said vertical panel, said rear vertical and horizontal panels being elongated and linear along their respective extensions, said front and rear vertical panels being generally parallel and said front and rear horizontal panels being generally co-planar, a divider section having a generally vertical panel positioned between and arranged generally perpendicular to said front and rear vertical panels, means on said divider section defining a generally horizontal product support surface extending generally coextensive with said divider section vertical panel, said divider section vertical panel and said product support surface extruded to be elongated and linear along their respective extensions, and releasable interlocking means including an elongated rib and mating slot arrangement comprising an elongated, linear rib located on each of said front and said rear horizontal panels and a pair of spaced slots located on said divider section so that when said ribs are engaged in said slots said front and rear panels are held in relatively spaced relation a distance corresponding to the length of said divider section.

2. The shelf unit of claim 1 including a front horizontal lip on and extending from said front vertical panel toward rear vertical panel, a rear horizontal lip on and extending from said rear vertical panel toward front vertical panel, and said front and rear horizontal lips each being disposed in overlying relation with a portion of said product support surface to hold said divider section against vertical movement relative to said front and rear panels.

3. The shelf unit of claim 2 including two of said divider sections relatively spaced in the direction of the longitudinal extension of said front and rear panels, and wherein said product support surfaces of each extend toward each other for support product therebetween and behind said front panel.

4. The shelf unit of claim 3 wherein said front vertical panel includes two sections arranged one above the other, and wherein the uppermost of said two sections is made of a clear, transparent material.

5. The shelf unit of claim 4 including a plurality of relatively spaced, elongated, pointed ribs on and, extending the length of the product support surfaces, said ribs being generally parallel to the longitudinal extension of said divider sections for engagement with product supported on said product support surfaces.

6. The shelf unit of claim 5 including elongated, ribs on the horizontal panels of said front and rear sections, said ribs extending generally parallel to the longitudinal extension of said front and rear sections and engaging said divider sections.

7. The shelf unit of claim 6 wherein said front and rear track sections are extruded members and said ribs on said horizontal panels thereof are extruded with said front and rear sections and are of a different material than the front and rear sections.

8. The shelf unit of claim 2 including two of said divider sections relatively spaced in the direction of the elongation of said front and rear tracks, said front and rear track sections extending between spaced divider sections, an elongated, linear pusher track positioned between said front and rear track sections and said divider sections, said pusher track including means defining elongated, linear ledges and an elongated recess between and defined by said ledges, said linear ledges and said recess extending between said front and rear track sections, a pusher assembly engaged in and movable relative to recess and said pusher track, said pusher assembly including a base engaged in said recess, a generally planar panel connected to and above said base, and a spring connected between the end of said pusher track adjacent said front track section and said pusher assembly panel and biasing said pusher assembly panel and said base toward said front track section and movable against said bias toward said rear track section, and wherein said elongated, linear edges of said pusher are generally co-planar with the horizontal surfaces of said divider sections so that product can be supported thereon.

9. The shelf unit of claim 8 wherein said pusher track includes a pair of generally aligned slots located adjacent the opposite ends of the pusher track and wherein said pusher track slots are engaged with said front and rear track ribs.

10. The shelf unit of claim 8 wherein said elongated, linear ledges include opposite ends and said opposite ends are positioned with said lips on said vertical panels of said front and rear tracks overlying said opposite ends of said elongated, linear ledges.

11. The shelf unit of claim 1 including two of said divider sections relatively spaced in the direction of the elongation of said front and rear tracks, said front and rear track sections extending between spaced divider sections, an elongated, linear pusher track provided on the vertical panel of one of said divider sections, said pusher track including means defining an elongated, linear slot on and extending the length of said divider section to which it is attached, a pusher assembly engaged in and movable relative to divider section slot, said pusher assembly including a base engaged in said slot, a generally planar panel connected to and extending laterally from said base and said divider to which it is attached, and a spring connected between the end of said divider section adjacent said front track section and said generally planar pusher panel and biasing said pusher assembly planar panel and said base toward said front track section and movable against said bias toward said rear track section.

12. The shelf unit of claim 1, wherein said vertical panel of said divider section defines a slot extending along said extension of said divider, said shelf unit further comprising a pusher having a portion received in said slot for sliding along said extension of said divider, said pusher adapted to engage product on said shelf unit and slide the product along said product support surface.

13. The shelf unit of claim 12, wherein said slot is substantially T-shaped and wherein said portion of said pusher is substantially T-shaped to compliment the shape of said slot.

14. The shelf unit of claim 12, wherein said slot is defined by a back wall that is substantially parallel to and non-coplanar with the rest of said vertical panel of said divider section, and is further defined by a pair of generally L-shaped members having a first leg extending substantially perpendicular to said vertical panel of said divider section and a second leg extending substantially parallel to said vertical panel of said divider section, said second legs of said L-shaped members extending toward one another but terminating in spaced relationship to define an opening to said slot, said portion of said pusher extending through said opening to said slot.

15. The shelf unit of claim 12, farther comprising a spring biasing said pusher toward said front track section.

16. The shelf unit of claim 15, further comprising a channel defined by said pusher, said spring being at least partially housed within said channel.

17. The shelf unit of claim 15, wherein said spring is a coil spring having a U-shaped free end interconnected with a front edge of said divider.

* * * * *